US010024324B2

(12) United States Patent
Blad

(10) Patent No.: US 10,024,324 B2
(45) Date of Patent: Jul. 17, 2018

(54) PUMP ASSEMBLY

(71) Applicant: Grundfos Holding a/s, Bjerringbro (DK)

(72) Inventor: Thomas Blad, Bjerringbro (DK)

(73) Assignee: Grundfos Holding a/s, Bjerringbro (DK)

( * ) Notice: Subject to any disclaimer, the term of this patent is extended or adjusted under 35 U.S.C. 154(b) by 500 days.

(21) Appl. No.: 14/368,852

(22) PCT Filed: Dec. 19, 2012

(86) PCT No.: PCT/EP2012/076060
§ 371 (c)(1),
(2) Date: Jun. 26, 2014

(87) PCT Pub. No.: WO2013/098142
PCT Pub. Date: Jul. 4, 2013

(65) Prior Publication Data
US 2015/0017031 A1 Jan. 15, 2015

(30) Foreign Application Priority Data
Dec. 27, 2011 (EP) ..... 11195804

(51) Int. Cl.
*F04D 13/06* (2006.01)
*F04D 29/041* (2006.01)
(Continued)

(52) U.S. Cl.
CPC ..... *F04D 13/0633* (2013.01); *F04D 13/06* (2013.01); *F04D 29/041* (2013.01);
(Continued)

(58) Field of Classification Search
CPC .... F04D 13/06; F04D 13/0633; F04D 29/041; F04D 29/0413; F04D 29/042;
(Continued)

(56) References Cited

U.S. PATENT DOCUMENTS 3,073,248 A 1/1963 Bartels
3,329,095 A 7/1967 Bartels
(Continued)

FOREIGN PATENT DOCUMENTS

DE 759538 C 4/1954
DE 3210761 C1 9/1983
(Continued)

OTHER PUBLICATIONS

Int'l Search Report dated Mar. 15, 2013 in Int'l Application No. PCT/EP2012/076060.
(Continued)

*Primary Examiner* — Dominick L Plakkoottam
(74) *Attorney, Agent, or Firm* — Panitch Schwarze Belisario & Nadel LLP

(57) ABSTRACT

A pump assembly includes an electric drive motor having a stator and a permanent magnet rotor, at least one impeller connected to the rotor via a rotor shaft, a thrust bearing accommodating axial forces acting on the impeller and rotor shaft in operation, and at least one radial bearing arranged on the rotor shaft. The rotor and stator are designed such that a magnetic axial force, acting in the direction of the rotation axis of the rotor and acting on the rotor in the direction of the inflow direction into the impeller, is produced between the rotor and the stator. The rotor shaft and rotor are mounted displaceably in the axial direction relative to the stator, and with an axial displacement of the rotor shaft in the inflow direction into the impeller, the bearing surfaces of the radial bearing lying opposite one another at least partly disengage.

18 Claims, 3 Drawing Sheets

(51) Int. Cl.

| | |
|---|---|
| ***F04D 29/049*** | (2006.01) |
| ***F04D 29/16*** | (2006.01) |
| ***F04D 29/042*** | (2006.01) |
| ***F04D 29/047*** | (2006.01) |

(52) U.S. Cl.
CPC ..... *F04D 29/042* (2013.01); *F04D 29/049* (2013.01); *F04D 29/0413* (2013.01); *F04D 29/0473* (2013.01); *F04D 29/167* (2013.01)

(58) Field of Classification Search
CPC .. F04D 29/0473; F04D 29/049; F04D 29/167; F04D 13/0613; F04D 29/2266
See application file for complete search history.

(56) References Cited

U.S. PATENT DOCUMENTS

| | | | | |
|---|---|---|---|---|
| 4,072,446 | A | 2/1978 | Walker | |
| 4,516,915 | A * | 5/1985 | Jensen | F04D 13/0613 310/87 |
| 4,569,638 | A | 2/1986 | Harker et al. | |
| 5,248,085 | A * | 9/1993 | Jensen | F24D 3/105 237/19 |
| 5,618,168 | A * | 4/1997 | Moon | F04D 29/167 415/170.1 |
| 2005/0106015 | A1 | 5/2005 | Osgood | |

FOREIGN PATENT DOCUMENTS

| | | | |
|---|---|---|---|
| DE | 102006024997 | A1 | 12/2007 |
| DE | 102009060549 | A1 | 6/2011 |
| EP | 1719916 | A1 | 11/2006 |
| EP | 2339181 | A2 | 6/2011 |
| JP | 200120895 | A | 1/2001 |

OTHER PUBLICATIONS

Communication of Opposition dated Jan. 9, 2017 in EP Application No. 12813319.6.
"Circular Pumps 50 Hz", Grundfos Alpha 2 Data Booklet, 5 pgs (Nov. 2007).

* cited by examiner

PUMP ASSEMBLY

CROSS-REFERENCE TO RELATED APPLICATIONS

This application is a Section 371 of International Application No. PCT/EP2012/076060, filed Dec. 19, 2013, which was published in the German language on Jul. 4, 2013, under International Publication No. WO 2013/098142 A1 and the disclosure of which is incorporated herein by reference.

BACKGROUND OF THE INVENTION

The invention relates to a pump assembly comprising: an electric drive motor having a stator and a rotor designed as a permanent magnet rotor; at least one impeller connected to the rotor via a rotor shaft; a thrust bearing designed such that it accommodates the axial forces acting on the impeller and the rotor shaft upon operation of the pump assembly; and at least one radial bearing arranged on the rotor shaft.

Pump assemblies are particularly known as heating circulation pump assemblies, which form a construction unit of a pump and an electric drive motor. The electric drive motors are often designed as permanent magnet motors, I.e., they comprise a permanent magnet rotor which rotates in the inside of a stator. At least one pump impeller which rotates in a pump housing, is connected to this permanent magnet rotor via a rotor shaft. On operation of the pump assembly, an axial force acts on the shaft, and this axial force is accommodated by a thrust bearing on the rotor shaft or the rotor.

These pump assemblies are designed as wet-running pump assemblies, I.e., the rotor runs in the inside of a can or canned pot in the fluid to be delivered. The bearings which mount or support the rotor or rotor shaft, as a rule are lubricated by the fluid to be delivered. With these pump assemblies, during longer periods of standstill, there exists the problem that contamination, which is contained in the fluid to be delivered, causes the bearings to become stuck, so that the motor can no longer start up due to a starting moment which is too low.

BRIEF DESCRIPTION OF THE INVENTION

With regard to this problem, it is an object of the invention to improve a pump assembly to the extent that the pump assembly can start up without any problem, even after longer periods of standstill.

This object is achieved by a pump assembly of the type described at the outset, wherein the rotor and the stator are designed such that a magnetic axial force acting in the direction of the rotation axis (X) of the rotor and acting on the rotor in the direction of the inflow direction (E) into the impeller, is produced between the rotor and the stator, wherein the rotor shaft with the rotor is mounted in a displaceable manner in the axial direction (X) relative to the stator, and wherein the radial bearing is designed such that with an axial displacement of the rotor shaft in the inflow direction (E) into the impeller, the bearing surfaces of the radial bearing which lie opposite one another, at least partly disengage.

Preferred embodiments may be deduced from the subsequent description as well as the attached figures.

The pump assembly according to the invention, as with known pump assemblies, comprises an electric drive motor which is preferably designed as a wet-running electric drive motor. The electric motor comprises a stator and a rotor designed as a permanent magnet rotor. In the case of a wet-running rotor, the rotor is arranged in the inside of a can or canned pot which separates the wet rotor space from the dry stator space, in which the stator is arranged. Moreover, the pump assembly comprises at least one impeller which is connected to the rotor via a rotor shaft. The impeller as with conventional centrifugal pump assemblies is preferably arranged in the inside of a pump housing which defines the suction-side and pressure-side flow paths.

Moreover, a thrust bearing is provided, which on operation of the pump assembly accommodates axial forces acting on the impeller and the rotor shaft. These are hydraulic axial forces which on operation as a rule are directed opposite to the inflow direction, in which the fluid to be delivered flows into the suction port of the impeller. The flow usually enters axially into the impeller and exits radially out of the impeller. The thrust bearing is preferably arranged or designed on the rotor shaft or on the rotor. Additionally to the thrust bearing, at least one radial bearing is arranged on the rotor shaft. This radial bearing can be designed as a separate component which is connected to the rotor shaft. Alternatively, the inner bearing surface can be formed by the outer peripheral surface of the rotor shaft itself, and this peripheral surface bears on a stationary, outer bearing surface.

According to embodiments of the invention, the permanent magnet rotor and the stator are designed in a manner such that a magnetic axial force is produced between the rotor and stator, and this axial force acts in the direction of the rotation axis of the rotor and is directed from the rotor onto the stator opposite to the inflow direction into the impeller. Thus, seen the other way round, this additional axial force acts on the rotor, in the direction of the inflow direction. That is, this magnetic axial force counteracts the hydraulic axial force which acts on the rotor and which occurs on normal operation. In particular, the arrangement of the permanent magnet rotor and the stator is designed such that this magnetic axial force also occurs when the pump assembly is not in operation, I.e., that the permanent-magnetic force acts in a permanent manner, in operation as well as with a standstill of the drive motor.

A relief of the thrust bearing with a standstill is achieved by way of this, so that the danger of an undesired blockage of the bearing given a standstill is reduced. Moreover, the bearing is also relieved when starting up the motor, so that the friction is reduced and thus the required starting moment is reduced. Preferably, this permanent-magnetic axial force results from the arrangement of the permanent magnet rotor and the stator relative to one another. Ideally therefore, no additional permanent-magnetic or soft-magnetic components are required. However, it is also conceivable to arrange an additional hard-magnetic, i.e., permanent-magnetic or soft-magnetic element or several such elements on the rotor and/or on the stator, wherein this element or these elements produce the magnetic axial force or contribute to its production.

Moreover, the rotor shaft with the rotor is displaceably mounted in the axial direction relative to the stator. This arrangement, by way of the additional magnetic axial force, permits a displacement of the rotor shaft in the axial direction in certain operating conditions or in the idle condition of the pump assembly. As described hereinafter, this preferably permits the bearings to at least partly disengage when the pump assembly is not in operation, whereby one avoids the bearings getting stuck. Moreover, a sealing of the rotor space, as described below, can also be achieved in the idle condition, in order to prevent a penetration of contamination into the rotor space.

Particularly preferably, the rotor shaft is movable in a manner such that it can displace axially in the inflow direction of the impeller, in the idle condition of the pump assembly. That is, in the idle condition, the rotor shaft on account of the permanent-magnetic force would displace axially in that direction, in which the fluid flows axially into the impeller, since an opposite hydraulic force is absent. This is the direction which is directed opposed to the axial force acting in normal operation of the pump assembly. If the pump assembly is taken into operation, the hydraulic axial force is preferably larger than the magnetic force, so that on account of the oppositely directed effect of the hydraulic axial force, the rotor shaft is displaced in the reverse direction again, i.e., opposite to the inflow direction.

Preferably, an axial force acting on the impeller and the rotor shaft on operation of the pump assembly is larger than the magnetic axial force which is directed opposite to this. Preferably, the hydraulic axial force is larger than the oppositely directed magnetic axial force over the whole operating range or at least in the normal operation range of the pump assembly. By way of this, one succeeds in the thrust bearing being held on the rotor shaft or on the rotor with a defined bearing contact, on account of the hydraulic axial force on operation. If the pump assembly is taken out of operation, the hydraulic axial force falls away, and it is then only the described permanent-magnetic force which continues to act and which then leads to a relocation of the rotor, with which the at least one radial bearing is at least partly disengaged. Depending on the design of the magnetic arrangement which causes the permanent-magnetic force, then in the idle condition, the permanent-magnetic axial force can be reduced or lifted.

What is essential is that the permanent-magnetic axial force, on operation of the pump assembly, acts counter to the hydraulic axial force such that with the loss of the hydraulic axial force, the magnetic axial force can cause a displacement of the rotor in the axial direction. That is, according to the invention, the permanent-magnetic axial force does not need to act on the rotor in all conditions of the pump assembly, but merely at least on switching off the pump assembly, in order then to displace the rotor shaft in the axial direction as desired. On re-starting the pump assembly, on account of the occurring hydraulic axial force, the rotor shaft can then be displaced again into a position, in which the at least one radial thrust bearing is fully engaged.

The at least one radial bearing is designed in a manner such that with an axial displacement of the rotor shaft in the inflow direction of the impeller, caused by the magnetic axial force, the bearing surfaces of the radial bearing which lie opposite one another at least partly disengage. In normal operation of the pump assembly, the bearing surfaces of the radial bearing lie opposite one another and bear on one another. By way of the axial displacement, one succeeds in the bearing surfaces being displaced axially relative to one another such that they continue to overlap only in a small region, i.e., the overlapping of the bearing surfaces is reduced and the bearing surfaces partly disengage. Thus, the friction in the radial bearing is reduced and the danger of a sticking with a standstill is reduced.

The stator surrounds the rotor preferably in a peripheral manner. With this arrangement, the permanent magnets in the rotor are usually magnetized in the radial direction or effect a radial magnetic field of the rotor. The permanent-magnetic magnetic field of the permanent magnets in the rotor interacts with the iron parts of the stator, whereby an additional axial force can be produced, given a suitable arrangement and design.

For example, the additional magnetic axial force can be achieved by way of the rotor and stator being designed and arranged in a manner such that at least on operation of the pump assembly, the axial middle of the rotor, i.e., the axial middle of the magnetically effective part of the rotor is spaced from the axial middle of the stator in a direction opposite to the inflow direction, in which the fluid enters the impeller. That is, the rotor relative to the stator is arranged offset towards the inflow opening or towards the suction port. However, due to the permanent-magnet magnetic field of the rotor, this rotor however seeks to center itself in the inside of the iron core of the stator, in the axial direction. Thus, a magnetic force is produced by the axial offset, which seeks to pull the rotor into the centered position. That is, ideally with a permanent magnet rotor which otherwise is designed in a conventional manner, and with an associated stator, one can produce an additional axial force in the desired direction on operation of the pump assembly alone by way of the axial offset.

The at least one impeller is fixed on the rotor shaft preferably in the axial direction. By way of this, one succeeds in the magnetic axial force which acts on the rotor, also acting on the impeller and moreover in fixing the impeller in the axial direction by the rotor.

Preferably, the thrust bearing is designed in a manner such that its bearing surfaces disengage with a displacement of the rotor shaft in the inflow direction into the impeller. Thus, one succeeds in the thrust bearing disengaging, particularly in the idle condition, when the hydraulic axial force does not act and the rotor shaft by way of the magnet force is displaced in the inflow direction, i.e., opposite to the axial force acting in normal operating. Thus, a sticking of the bearing in the idle condition is prevented. Moreover, the friction is reduced with a new starting up.

Particularly preferably, the at least one radial bearing is designed as a sliding bearing, of which a first bearing surface is formed on the outer periphery of the rotor shaft and an oppositely lying second bearing surface is formed in a stationary bearing ring. The stationary bearing ring is preferably designed as a ceramic bearing ring. The rotor shaft can also be designed preferably as a ceramic shaft or at least preferably comprise ceramic bearing surfaces.

Further preferably, on at least one side of a bearing surface of the radial bearing, said side facing the impeller and said bearing surface formed on the rotor shaft, the diameter of the rotor shaft is reduced compared to the diameter of this bearing surface. By way of this, when the rotor shaft is displaced by the magnetic axial force in the direction away from the impeller, i.e., the inflow direction of the impeller, one succeeds the surface of the rotor shaft which is reduced in diameter entering into the radial bearing or bearing ring, so that in this region the bearing surface on the inner periphery of the bearing ring no longer bears on the outer periphery of the rotor shaft. In this manner, the bearing surfaces of the radial bearing at least partly disengage, so that the friction on starting up and the danger of sticking of the radial bearing are reduced.

Particularly preferably, two radial bearings are arranged on the rotor shaft and are designed in the manner described above, wherein the two bearings are preferably situated at opposing axial sides of the rotor. That is, one radial bearing is preferably situated on the side of the rotor which is away from the impeller. This radial bearing is preferably arranged in the proximity of the base of a canned pot. The second radial bearing is arranged on the side of the rotor which faces the impeller and can be part of a combined radial-thrust bearing, which is arranged between the rotor and impeller on the rotor shaft.

According to a particularly preferred embodiment, the bearing surfaces of the radial bearing which lie opposite one another, with regard to their axial extension are dimensioned, and arranged relative to one another, in a manner such that with an axial displacement of the rotor shaft by more than 50%, they preferably disengage by more than 75%. That is, preferably only a very narrow region of the bearing surfaces continues to be in bearing contact or engaged, in order to hold the rotor and impeller in a positioned manner and to ensure a bearing support when starting up the drive motor. The largest part of the bearing surfaces however disengages, so that the friction is considerably reduced and the danger of sticking of the bearing by way of contamination between the bearing surfaces is minimized.

The impeller at its suction port is preferably sealed with respect to the pump housing via a suction seal. Thereby, the suction seal forms a stationary component on the pump housing. Preferably, the suction seal is arranged with respect to the impeller, in a manner such that with an axial displacement of the rotor shaft in the inflow direction of the impeller, the suction seal and the impeller at least partly, preferably completely disengage. By way of this design, one succeeds in preferably the seal being able to disengage from the impeller given a standstill of the pump assembly when the rotor is pulled into the stator on account of the magnetic force. On the one hand, one prevents this seal from sticking during the standstill, and on the other hand, the through-flow capability of the pump assembly at standstill is improved, since this fluid can flow past the impeller through the pump housing, and the impeller offers no or only a significantly reduced resistance to this flow. Particularly preferably, this design, with which the suction seal of the impeller disengages from the impeller given a standstill, is used in combination with the bearings, in which the bearing surfaces at least partly disengage with a standstill. However, it is to be understood that this arrangement of the suction seal on the impeller can also be realized independently of the respective design of the bearings.

Further preferably, the rotor shaft is displaceable by an amount which is smaller or equal to an axial distance between the axial middle of the rotor and the axial middle of the stator, the distance existing on operation of the pump assembly. That is, the axial movability of the rotor shaft is limited, and specifically to an amount which is smaller or equal to the axial offset between the rotor and the stator occurring in operation. By way of this, one ensures that an adequate magnetic axial force always acts on the rotor shaft, in order to be able to displace this by the desired amount.

According to a further preferred embodiment, an emergency bearing surface which faces a stationary thrust bearing surface, is formed on the at least one impeller on an axial side which faces the rotor. In certain operating conditions, in particular with a high throughput and low pressure, the hydraulic axial force acting on the impeller opposite to the inflow direction can reduce so greatly, that the thrust bearing accommodating this force in operation is relieved. It can then occur that the bearing surfaces of this thrust bearing are no longer held in bearing contact in this operating condition. One is to provide the oppositely directed emergency bearing, in order in this operating condition to also ensure an thrust bearing support in the opposite direction. Moreover, the emergency bearing preferably comes into operation when the rotor shaft is displaced in the axial direction by the magnetic force, in the previously described manner. In this case, the emergency bearing serves as an abutment which limits the movement of the rotor shaft in the axial direction. In the opposite direction, the movement is limited by the actual thrust bearing. Thus, the emergency bearing also acts with the starting-up of the drive motor from the idle position, when the actual thrust bearing is not yet in bearing contact.

The thrust bearing surface, on which the emergency bearing surface comes to bear, is preferably formed by an axial face-side of a stationary bearing ring, of a radial and/or thrust bearing of the rotor shaft. This bearing ring, as described above, is preferably a ceramic component whose front side preferably forms the actual thrust bearing surface. This front side is the side of the bearing ring which is away from the impeller and which faces the rotor. The radial bearing surface is formed by the inner peripheral surface of the bearing ring. The thrust bearing surface, on which the emergency bearing comes to bear, is then the axial rear side which faces the impeller. If the emergency bearing surface of the impeller comes to bear on this rear side of the bearing ring, then by way of this simultaneously the bearing gap between the rotor shaft and the inner periphery of the bearing ring is closed to the pump space, in which the impeller is arranged, so that a penetration of contamination into the bearing gap can be prevented. Preferably, the impeller is arranged relative to the bearing ring in a manner such that, by way of axial displacement of the rotor shaft, the emergency bearing surface can be brought into bearing contact with the stationary thrust bearing surface. Thus, with an axial displacement of the rotor shaft in the idle condition, the emergency bearing can be brought into bearing contact on the bearing ring, so that the bearing gap is closed by the emergency bearing surface in the idle condition when the pump assembly stands still.

The emergency bearing surface is further preferably formed by an annular projection on the impeller, said projection projecting in the axial direction. The impeller is preferably manufactured with this projection as one piece, from plastic.

In normal operation of the pump assembly, the emergency bearing surface is preferably axially spaced from the stationary thrust bearing surface. In this condition, preferably the normal thrust bearing is engaged, in order to accommodate the hydraulic axial forces which act on the impeller and rotor. That is, the normal operating condition is that one, in which such a hydraulic force acts opposite to the inflow direction into the impeller. Preferably, the distance of the emergency bearing surface to the stationary thrust bearing surface is smaller or equal to an axial distance between the axial middle of the rotor and the axial middle of the stator, which exists on operation of the pump assembly. By way of this arrangement, one ensures that with the displacement of the rotor shaft, in order bring the emergency bearing into and out of engagement with the thrust bearing surface, the offset is not larger than the offset between the rotor and stator, so that a magnetic axial force is always given, which holds the emergency bearing surface in bearing contact with the thrust bearing surface as long as no oppositely acting hydraulic axial force leads to a displacement of the rotor shaft in the opposite direction and disengages the emergency bearing surface from the thrust bearing surface.

According to a further preferred embodiment, at least one sealing element can be arranged between the rotor shaft or the impeller on the one hand, and a stationary bearing ring or a bearing holder on the other hand, and this sealing element can be brought into sealing bearing contact by way of the axial displacement of the rotor shaft. Thus, e.g., an annular sealing element can be arranged on the impeller and can likewise be able to be brought into sealing bearing contact with the face-side of a stationary bearing ring. Instead of an arrangement of the sealing element on the impeller such that it can be brought into bearing contact on the face-side of a stationary bearing ring, the sealing element on the impeller can also be arranged or designed such that it can come into bearing contact on the surface of a bearing carrier surrounding the bearing or the bearing ring.

Alternatively, such a sealing element can also be arranged on the thrust bearing surface of the bearing ring, and the impeller can come into bearing contact there with a suitable sealing surface with an axial movement of the rotor shaft. It would also be possible not to arrange such an annular seal on the impeller, but on the rotor shaft, such that for example it can come into bearing contact with the stationary bearing ring. With all these arrangements, the seal can thus sealingly close the bearing gap between the bearing ring and the rotor shaft in the idle condition of the pump assembly, in order to prevent a throughflow of the bearing and a penetration of contamination.

It is to be understood that this sealing of the bearing gap by way of axial displacement of the rotor shaft could also be realized independently of the design, with which the bearings at least partly disengage by way of the axial displacement of the shaft. If the axial displacement of the rotor shaft is only used to bring the sealing element into and out of bearing contact, then a significantly smaller axial offset of the rotor shaft can be sufficient, in order to effect this. This has the advantage that the rotor needs to be axially offset by only a small amount relative to the stator, so that the magnetic efficiency is essentially not compromised.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
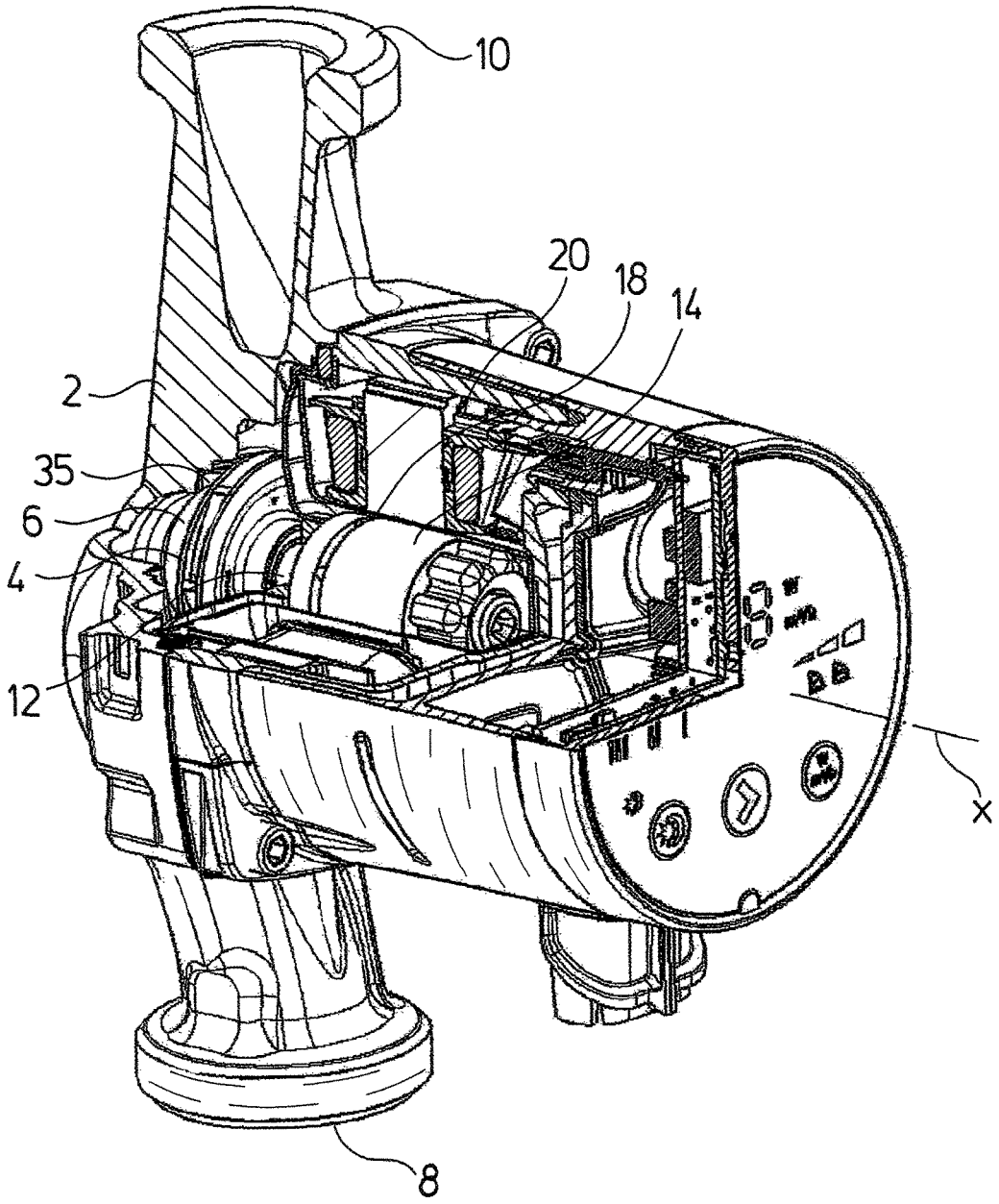
FIG. 1 is a partly sectioned overall view of a pump assembly according to one embodiment of the invention.

The pump assembly according to the invention comprise a pump housing 2, in which an impeller 4 is arranged. The impeller 4 has an axially directed central suction port 6, through which the fluid to be delivered enters into the impeller 4. The suction port 6 in the inside of the pump housing 2, lies opposite a flow channel which runs into a suction union 8. Moreover, a pressure union 10 is arranged on the pump housing 2 oppositely to the suction union 8, and via a flow channel is in connection with the peripheral region of the impeller 4 which forms a spiral channel. The impeller 4 is connected via a rotor shaft 12 to a permanent magnet rotor 14. The rotor shaft 12 is preferably manufactured of ceramic. Permanent magnets 16 are arranged in the rotor 14 and produce a radially directed magnetic field of the rotor 14. The permanent magnet rotor 14 is arranged in the inside of a can 18 or a canned pot 19. The can 19 is surrounded by the stator 20.

The impeller 4 is connected to the rotor shaft 12 in a rotationally fixed manner and in a fixed manner in the axial direction X. The rotor shaft 12 is slidingly mounted in two ceramic bearing rings 22 and 24. Thereby, the bearing ring 22 is a pure radial bearing. The bearing ring 24 at the same time assumes the function of the thrust bearing. For this, the axial face-side of the bearing ring 24 which is away from the impeller 4 is designed as a thrust bearing surface, on which a thrust bearing ring 26 connected to the rotor shaft 12 comes into bearing contact. The thrust bearing ring 26 is fixed on the rotor shaft 12 in the axial direction X.

In normal operation of the pump assembly, an axial force which is directed in the direction of the longitudinal axis or rotation axis X and which is directed oppositely to the inflow direction E into the suction port 6 of the impeller 4, acts on the impeller 4 and the rotor shaft 12. This hydraulic axial force is transmitted by the thrust bearing ring 26 onto the axial side 28 of the bearing ring 24, which is away from the impeller 4 and which forms a stationary thrust bearing surface.

The ceramic shaft 12 with its outer peripheral surfaces slidingly bears on the inner periphery of the bearing rings 22 and 24, for the radial mounting.

Figure 2:
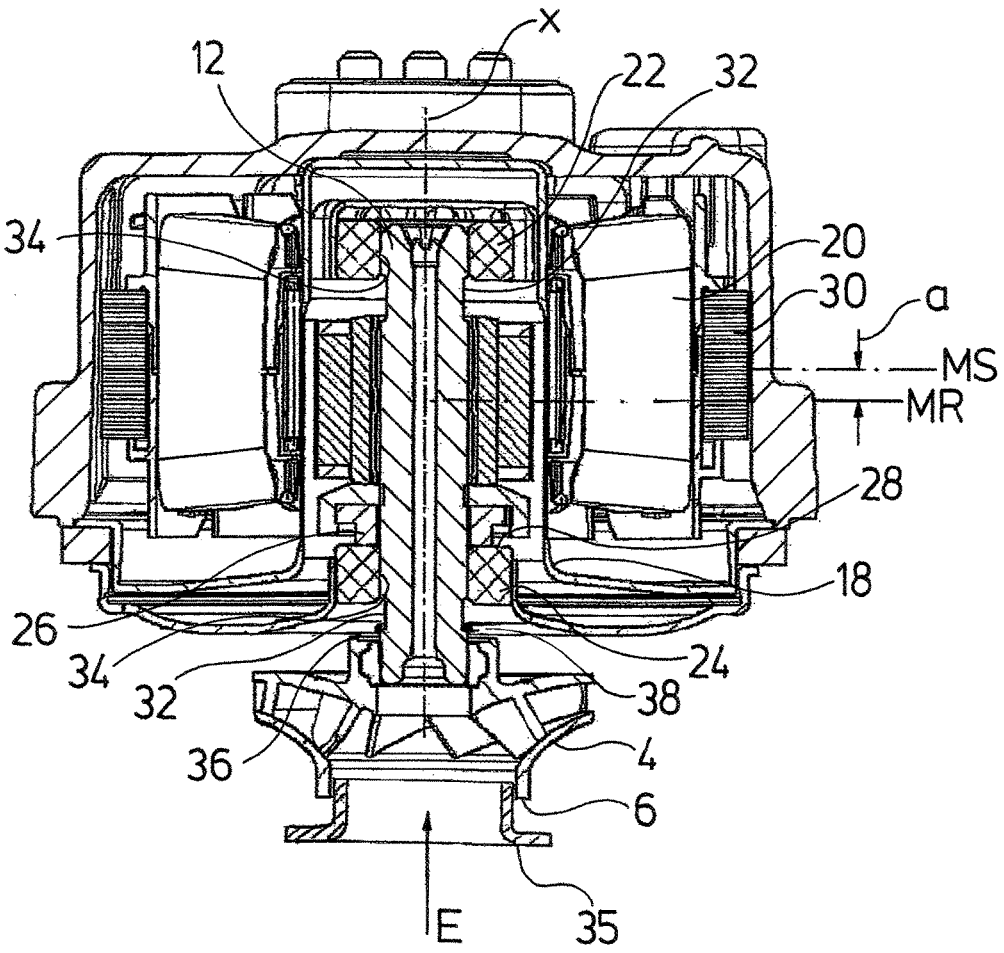
FIG. 2 is a sectional view of the pump assembly having a removed pump housing in the operating condition.

The rotor shaft 12 is movable in the axial direction X and in normal operation of the pump assembly is held by way of hydraulic axial force, in the condition shown in FIG. 2, in which the rotor shaft 12 is displaced so far opposite to the inflow direction E, that the thrust bearing ring slidingly bears on the axial side 28 of the bearing ring 24. In this condition, the axial middle MR of the rotor, i.e., of the magnetically effective part of the rotor, is displaced by an amount a in the axial direction with respect to the axial middle MS of the stator 20 or of the iron part 30. Due to the magnetic forces which act between the permanent magnet 16 and the iron part 30 of the stator 20, the rotor 12 however seeks to center itself with respect to the iron part 30, so that the axial middle MR of the rotor 12 is congruent with the axial middle MS of the iron part 30. By way of this, a magnetic axial force acting in the inflow direction E is produced, and this force acts on the rotor shaft 12 and is opposite to the hydraulic axial force which acts on the impeller 4 on operation of the pump assembly. The pump assembly or the drive motor is designed such that this magnetic force in normal operation, i.e., preferably in most operational regions of the pump assembly, is smaller than the hydraulic force, so that the thrust bearing ring 26 is held in bearing contact on the axial side 28 of the bearing ring 24.

Figure 3:
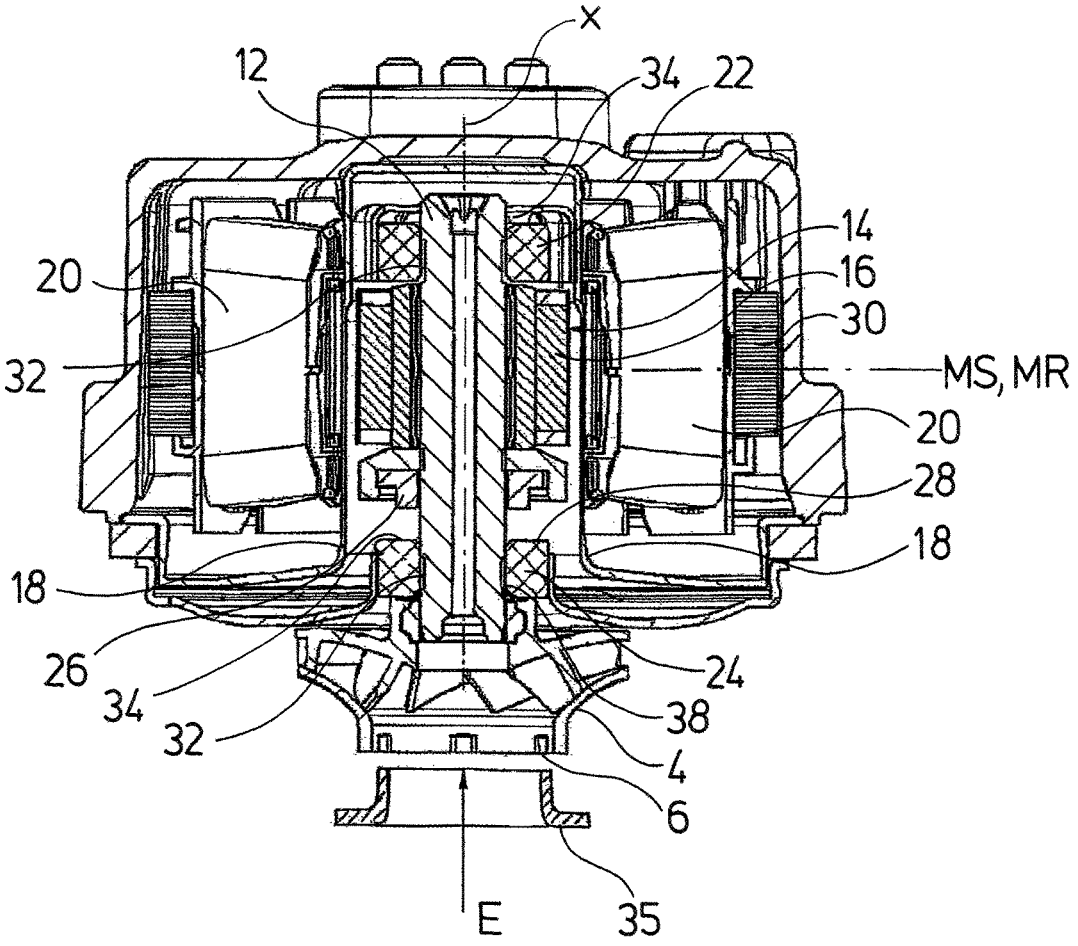
FIG. 3 is a view of the pump assembly according to FIG. 2, but in the idle condition.

If the pump assembly is switched off, the hydraulic axial force which act on the rotor shaft 12 falls away and it is only the magnetic axial force which then continues to act, and which then pulls the rotor in the direction of the longitudinal axis X into its centered position, in which the axial middle MR of the rotor 12 is congruent with the axial middle MS of the iron part 30 of the stator 20, as is shown in FIG. 3. In this condition, the thrust bearing ring 26 is thus disengaged from the axial side 28 of the bearing ring 24 and thus the thrust bearing is disengaged.

Notches 32, in whose region the outer diameter of the rotor shaft 12 is reduced, are formed adjacent the regions of the rotor shaft 12 which form radial bearing surfaces 34 cooperating with the bearing rings 22 and 24, on the outer periphery of the rotor shaft. The notches 32 border the side of the bearing surfaces 34 which face the impeller 4. If the rotor shaft in the idle condition is displaced into the condition shown in FIG. 3, these notches 32 with a reduced diameter enter into the bearing rings 22 and 24 and a section of the bearing surfaces 34 simultaneously exits from the bearing rings 22 and 24 at the opposite axial end. That is, the bearing surfaces 34 partly disengage from the inner peripheral surfaces of the bearing rings 22 and 24 which form their radial bearing surfaces. In this manner, the friction in the radial bearings 22 and 24 is reduced in the idle condition and the danger of a sticking in the bearings is minimized.

The impeller 4 at its suction port 6 is sealed with respect to the pump housing 2 via a suction seal 35. The suction seal 35 is fixed on the pump housing 2 and engages into the suction port 6. On operation of the pump impeller, the inner periphery of the suction port 6 thus overlaps the outer periphery of the suction seal 35, wherein the suction port 6 rotates relative to the suction seal 35. The suction seal can be designed in a conventional manner as a collar-like sheet metal component.

If, given a standstill of the pump assembly, the rotor shaft 12 is displaced into the axial position shown in FIG. 3, the impeller 4 with the rotor shaft 12 moves in the direction of the stator 20. Thereby, this axial shift with the example shown here is so large, that the suction port 6 of the impeller completely disengages from the suction seal 35, so that a gap arises between the axial side of the impeller 4 which is away from the rotor 14 and the face-side of the suction seal 35. By way of the complete disengagement of the suction seal 35 from the suction port 6, one prevents the suction seal 35 from sticking on the suction port 6 during standstill. Moreover, the pump assembly at standstill can thus be subjected to an improved throughflow, since the flow can be effected through the gap between the suction seal 35 and the face-side of the impeller 4, past the impeller through the pump housing 2 to the pressure union 10. Thus, the flow resistance is reduced at standstill.

The impeller 4 at its face-side which is away from the suction port 6 comprises an annular projection 36 which faces the bearing ring 24. The projection 36 is manufactured as one piece with the impeller 4 of plastic and forms an emergency bearing surface. In operating conditions, in which the hydraulic axial force is not sufficient to hold the thrust bearing in bearing contact, i.e., to hold the thrust bearing ring 26 in bearing contact on the axial side 28 of the bearing ring 24, it can occur that even during the operation, the rotor shaft 12 moves in the position shown in FIG. 3. Then the projection 36 as an emergency bearing provides a thrust bearing support or mounting in the opposite direction, in which it comes to bear on the axial side of the bearing ring 24 which faces the impeller 4 and which is away from the axial side 28 which forms the actual thrust bearing surface. Such an operating condition can particularly occur with the starting up of the pump assembly. Moreover, with this embodiment, thus even with a standstill of the pump assembly, the projection 36 bears on the rearward axial side of the bearing ring 24, so that the bearing gap between the bearing ring 24 and the rotor shaft 12 is sealed to the pump space, in which the impeller 4 is arranged. Thus, a penetration of contamination into the bearing gap and the rotor space can be prevented.

In this embodiment example moreover, an annular seal 38 is further shown, which in this embodiment example is peripherally arranged on the rotor shaft 12. Thereby, the seal 38 is arranged essentially in the region of the axial end of the impeller 4 on the outer periphery of the rotor shaft 12, the axial end facing the rotor 14. If the rotor shaft 12 is located in the axial position, which is shown in FIG. 3 and in which it is axially displaced in the inflow direction E, this seal 38 comes to sealingly bear on the bearing ring 24 in the region of the bearing gap. Such a seal 38 could also be formed on the impeller 4 in the peripheral region of the rotor shaft 12, in particular can be cast of an elastic plastic directly onto the impeller 4. Such a seal 38 could also be used alternatively to the projection 36, as also the projection 36 can be applied without the seal 38.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A pump assembly comprising:

an electric drive motor having a stator and a rotor designed as a permanent magnet rotor;

at least one impeller connected to the rotor via a rotor shaft;

a thrust bearing designed to accommodate axial forces acting on the at least one impeller and the rotor shaft upon operation of the pump assembly; and at least one radial bearing arranged on the rotor shaft, the radial bearing having a first bearing surface located on the outer periphery of the rotor shaft and a second, fixed bearing surface, wherein the rotor and the stator are designed such that a magnetic axial force is produced between the rotor and the stator, acting in an axial direction (X) of the rotor and acting on the rotor in an inflow direction (E);

wherein the rotor shaft with the rotor is mounted in a displaceable manner in the axial direction (X) relative to the stator; and wherein the radial bearing is designed such that, with an axial displacement of the rotor shaft in the inflow direction (E), the first bearing surface and the second bearing surface of the radial bearing lying opposite one another at least partly disengage from each other in an idle state of the pump assembly.

2. The pump assembly according to claim 1, wherein a hydraulic axial force acting on the at least one impeller and the rotor shaft upon operation of the pump assembly is larger than the oppositely directed magnetic axial force.

3. The pump assembly according to claim 1, wherein the stator peripherally surrounds the rotor.

4. The pump assembly according to claim 1, wherein the rotor and the stator are designed and arranged such that, at least upon operation of the pump assembly, an axial middle (MR) of the rotor is spaced from an axial middle (MS) of the stator, in a direction opposite to the inflow direction (E).

5. The pump assembly according to claim 1, wherein the at least one impeller is fixed in the axial direction on the rotor shaft.

6. The pump assembly according to claim 1, wherein the rotor shaft is movable such that it can axially displace in the inflow direction (E), in an idle condition of the pump assembly.

7. The pump assembly according to claim 6, wherein the thrust bearing has a movable first bearing surface axially fixed on the rotor shaft and a fixed second bearing surface, and the thrust bearing is designed such that the movable first bearing surface and the fixed second bearing surface disengage from each other with a displacement of the rotor shaft in the inflow direction (E).

8. The pump assembly according to claim 1, wherein the radial bearing is designed as a sliding bearing, and the second bearing surface is formed in a stationary bearing ring.

9. The pump assembly according to claim 1, wherein in a region adjacent the first bearing surface, a diameter of the rotor shaft is reduced compared to a diameter of the first bearing surface on the rotor shaft.

10. The pump assembly according to claim 1, wherein the first bearing surface and the second bearing surface lying opposite one another are dimensioned in their axial extension and are arranged relative to one another such that with the axial displacement of the rotor shaft the first bearing surface and the second bearing surface disengage from each other by more than 50%.

11. The pump assembly according to claim 1, further comprising a suction seal arranged adjacent to the at least one impeller such that, with an axial displacement of the rotor shaft in the inflow direction (E), the suction seal and the at least one impeller at least partly disengage.

12. The pump assembly according to claim 4, wherein the rotor shaft is displaceable by an amount smaller than or equal to an axial distance (a) between the axial middle (MR) of the rotor and the axial middle (MS) of the stator, the axial distance existing upon operation of the pump assembly.

13. The pump assembly according to claim 1, wherein the thrust bearing has a stationary thrust bearing surface formed on a face of a stationary surface axially facing the impeller, and wherein the pump assembly further comprises an emergency bearing surface facing the stationary thrust bearing surface and formed on the at least one impeller on an axial side facing the rotor.

14. The pump assembly according to claim 13, wherein the stationary thrust bearing surface is formed by an axial face-side of a stationary bearing ring of the thrust bearing of the rotor shaft.

15. The pump assembly according to claim 13, wherein the at least one impeller is arranged such that the emergency bearing surface can be brought into bearing contact with the stationary thrust bearing surface by the axial displacement of the rotor shaft, wherein upon operation of the pump assembly, the emergency bearing surface is axially spaced from the stationary thrust bearing surface.

16. The pump assembly according to claim 15, wherein the spacing of the emergency bearing surface to the stationary thrust bearing surface is smaller or equal to an axial distance (a) between an axial middle (MR) of the rotor and an axial middle (MS) of the stator, the axial distance existing upon operation of the pump assembly.

17. The pump assembly according to claim 1, further comprising at least one sealing element arranged either between the rotor shaft and a stationary bearing ring, or between the at least one impeller and a stationary bearing ring, such that the sealing element can be brought into sealing bearing contact by the axial displacement of the rotor shaft.

18. The pump assembly according to claim 1, wherein the first bearing surface and the second bearing surface lying opposite one another are dimensioned in their axial extension and are arranged relative to one another such that with the axial displacement of the rotor shaft the first bearing surface and the second bearing surface disengage from each other by more than 75%.

* * * * *